United States Patent [19]

Johnson et al.

[11] Patent Number: 4,899,411

[45] Date of Patent: Feb. 13, 1990

[54] PROCESS FOR APPLYING A FLOCKED COATING TO A CLOTH SURFACE SUCH AS A TENNIS SHOE

[75] Inventors: Donald H. Johnson, Edina; Benedict F. Gorecki, Milaca, both of Minn.

[73] Assignee: Donald H. Johnson, Edina, Minn.

[21] Appl. No.: 199,000

[22] Filed: May 26, 1988

[51] Int. Cl.[4] ..... A43B 23/00; A43D 8/16

[52] U.S. Cl. ..... 12/142 R; 12/142 E; 12/142 P; 12/146 C; 36/45; 36/98; 427/206; 428/90

[58] Field of Search ..... 36/45, 47, 98, 114; 12/142 R, 142 E, 142 EV, 146 C; 428/90; 427/206

[56] References Cited

U.S. PATENT DOCUMENTS

| | | | |
|---|---|---|---|
| Re. 26,340 | 2/1968 | Dassler | 36/98 X |
| 1,320,670 | 11/1919 | Braselton . | |
| 1,408,871 | 3/1922 | Enos | 36/45 X |
| 1,731,740 | 10/1929 | Glidden et al. | 427/206 X |
| 2,106,132 | 1/1938 | Feinbloom | 427/206 X |
| 2,901,373 | 8/1959 | Weiss | 428/90 X |
| 3,119,191 | 1/1964 | Vitzthum . | |
| 3,262,128 | 7/1966 | Morgan et al. | 427/206 X |
| 3,904,201 | 9/1975 | Henry . | |
| 4,075,973 | 2/1978 | Geary et al. | 427/206 X |
| 4,147,813 | 4/1979 | Casey | 427/206 X |
| 4,151,662 | 5/1979 | Vistins . | |
| 4,287,629 | 9/1981 | Stalteri | 12/142 R |
| 4,294,577 | 10/1981 | Bernard . | |
| 4,359,783 | 11/1982 | Andrews . | |
| 4,482,593 | 11/1984 | Sagel et al. . | |
| 4,560,604 | 12/1985 | Shimizu et al. . | |
| 4,734,307 | 3/1988 | Thorsrud | 428/90 |

FOREIGN PATENT DOCUMENTS

| | | | |
|---|---|---|---|
| 2256462 | 6/1974 | Fed. Rep. of Germany | 36/59 R |
| 60-199984 | 10/1985 | Japan | 428/90 |
| 1347925 | 10/1987 | U.S.S.R. | 36/47 |
| 1445781 | 8/1976 | United Kingdom | 36/45 |

*Primary Examiner*—James Kee Chi

*Attorney, Agent, or Firm*—Kinney & Lange

[57] ABSTRACT

A process for applying a flocking fiber to a cloth surface of a shoe includes the step of spraying a clean dry cloth shoe with an adhesive, which adheres to the cloth substrate without excess penetration, which remains pliable, and is not water soluble when set. A short set time is desirable, and then flock fibers suitable for application are carried into a charge in an electrostatic field. A conventional flocking chamber is used, voltage is applied to the electric field, and the flock fibers are applied so that they adhere to the adhesive surface under controlled conditions. The shoe is dried in a drying oven, and then it is ready for use. The flocking process can use adhesives that are colored, flock that is colored, and the flock can be applied in any desired pattern because of the use of the adhesive for causing the flock material to adhere to the cloth surface.

5 Claims, 1 Drawing Sheet

PROCESS FOR APPLYING A FLOCKED COATING TO A CLOTH SURFACE SUCH AS A TENNIS SHOE

BACKGROUND OF THE INVENTION

1. Field of the Invention.

The present invention relates to processes for applying a flock fiber material onto a shoe.

2. Description of the Prior Art.

U.S. Pat. No. 4,287,629 relates to the process and apparatus for production of a synthetic chamois leather footwear, and in this process a molded synthetic shoe, preferably molded from PVC is held in a special vise or support so as to cover portions not intended to be coated with the flock material. An organic solvent based adhesive that is capable of partial solubilization of the surface is supplied, so that the flock fiber penetrates into the support material as if it were a hair rooted in the material. An electrostatic application of a rayon fiber flock is made, and the resulting surface has a nap, that is, the fibers are linearly oriented so the when stroked the fibers are bent slightly and the path of the stoke can be seen. This process is not used for cloth or flexible materials.

U.S. Pat. No. 3,119,191 describe a velvet coating that can be applied without an adhesive to shoe materials.

U.S. Pat. No. 4,151,662 and U.S. Pat. No. 4,359,783 provide processes for coating a surface having embedded fibers. Fibers are not applied, but derive from the cut or piled surface of an underlying fabric. No flocked or velvet appearing surface is sought or obtained with either or these processes. Patent '783 deals with a glove member that is primarily designed for gripping and the palm of the glove is constructed as a laminate, while the back is a conventional woven or knit fabric.

Patent '662 shows a textured boot, a glove, and also a textured apron. The textile wearing apparel shown in the patent uses a base fabric having fibrous nap. An elastomer resin is applied to the fabric surface, and then the elastomer coating entraps fibers or naps, to provide an uneven base and a wrinkled finish, rather than a smooth velvety finish such as desired with a canvas athletic shoe.

U.S. Pat. No. 1,320,670 provides a metallic coating applied by a spray onto a shoe.

Patents that illustrate the state of the art include U.S. Pat. No. 4,560,604, which discloses a method for forming a flocked cloth, using epoxy resins to bind the flocking; U.S. Pat. No. 4,482,593 describes a method of manufacturing a floor mat; and U.S. Pat. No. 3,904,201 shows a tennis ball that is flocked with nylon fibers.

U.S. Pat. No. 4,294,577 illustrates a dyed flocked fabric and method of making the same, which includes flocking the material by applying an adhesive to it and passing it through drying and curing ovens.

SUMMARY OF THE INVENTION

The invention provides a process for applying a flock material to an athletic shoe or cloth shoe, which shoe is made in a conventional manner, and then is covered in at least selected areas with an adhesive, preferably by spraying. The adhesive can be blanked or divided with a pattern on the shoe itself, to have decorative designs. The adhesive is chosen so that it will adhere well to the cloth substrate and is thinned so it penetrates the cloth without excess penetration to the interior. The adhesive is selected so it will remain pliable. The adhesive should not be water soluble when set. A relatively short set time is desired for the adhesive. After the adhesive is applied the shoe is placed into a conventional electrostatic flock applying machine, in which flock fibers ranging in denier from one to 10, and having a length of 1.0 to 10 mm are applied, depending on the effect sought. The flocking fibers can be selected for desired use, but it has been found that for durability and evenness of application, a rayon fiber of about 3 denier by 3 to 4 mm in length is desired.

DETAILED DESCRIPTION OF THE PREFERRED EMBODIMENTS

Figure 1:
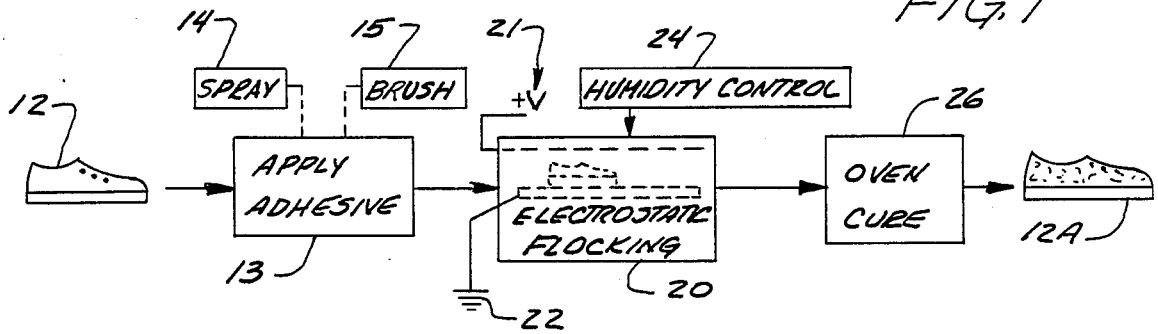
FIG. 1 is a schematic representation of a typical process of applying flock fiber material to a canvas or cloth athletic shoe in accordance with the present invention.

In preparation for flocking, a clean, dry, shoe 12 has flexible, preferably cloth or canvas uppers or sides which are treated by applying adhesive in a suitable booth 13, or in another suitable location depending on the existing circumstances, and this can be either done with a spray gun 14, or a brush 15 in order to obtain the desired adhesive pattern. The adhesive that is chosen must adhere well to the substrate cloth, without excess penetration, so that the interior of the shoe remains uneffected by the application of the adhesive. The adhesive also has to be pliable or flexible so that the cloth can flex in a normal manner for a shoe, and must not be water soluble when set because the shoe will be worn and may be used where water is present.

A "Texon" flock adhesive sold by Advance Process Supply of 400 North Noble, Chicago, Ill. 60622 has been found satisfactory. It is available in various colors. The adhesive is mixed on a one to one ratio with a petroleum distillate thinner to permit spraying it onto a fabric and also to allow the adhesive to penetrate the flocking material. The thinner may be a T-125 thinner sold by Advance Process Supply.

A relatively short adhesive set time is desired. Another adhesive may be a type of flexible epoxy. BF Goodrich also provides suitable resin emulsions which include polyvinyl acetate, polyacrylic, polyvinyl chloride, and polyurethane. Such adhesives are sold by BF Goodrich through a conventional commercial catalog. The adhesive layer should be at least 0.10 mm thick and the properties can be selected as desired and the layer preferably is kept as thin as possible, but has to form a covering coating and have adequate adhesion to the cloth surface. The process includes the use of a standard electrostatic flocking housing 20 that has a voltage supplied from a source 21, and a ground 22, that provides an electrostatic charge with respect to the shoe 12 that is supported in the housing 20. The voltage differential would be in the range of between 20 and 100 kilovolts. A humidity control indicated generally at 24 is provided to control the humidity inside the electrostatic application housing 20, and if a nylon flocked material or fiber is used, the relative humidity must be maintained at about 60 percent. One way of keeping the humidity high is the use of a saltwater spray within the interior chamber of housing 20. This would be a very fine spray applied into the atmosphere. After the flocking is completed, a drying oven 26 is provided in the process for heat drying the shoe after flocking, after which the finished product indicated generally at 12A is ready for use.

Figure 2:
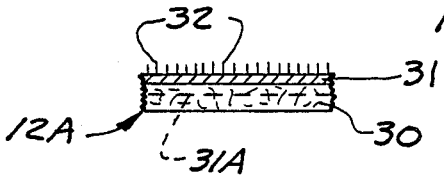
FIG. 2 is a sectional view through a typical panel of a shoe made according to the present invention.

FIG. 2 illustrates a cross section of a flocked shoe 12A, after flocking has been completed. The shoe has a flexible cloth material upper, such as canvas or flexible leather or synthetic material indicated generally at 30, which is of conventional design, used now in shoes of various kinds. A layer of adhesive 31, which as disclosed should be at least 0.1 mm thick on the cloth exterior. The adhesive penetrates into the cloth a short distance, for example, as indicated in dotted lines at 31A. The flocking fibers indicated generally at 32 are preferably between one to 10 denier, with a length between 1.0 and 10 mm. The 1 mm length is a very short fiber that would protrude only a short distance from the cloth surface, while a 10 mm length fiber would be able to be pressed sideways and bent and moved to form patterns, just like a deep pile carpet. Preferably, the flocking fiber is 3 denier in thickness or diameter by 3 to 4 mm in length.

The preferred flock is a rayon wash-fast, short fibered flock material conventionally available. The rate of coverage is about 90 to 110 square feet per pound of flock.

Figure 3:
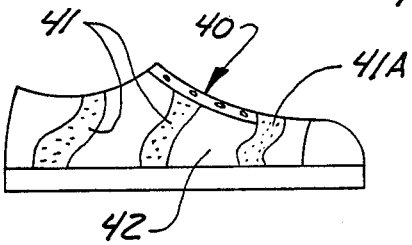
FIG. 3 is a side elevational view of an athletic shoe having a flocked pattern in a desired design on the exterior thereof.

FIG. 3 shows a finished athletic shoe made according to the present invention indicated generally at 40. As shown, the shoe upper has stripes at 41 of flocked material, which are formed by applying the adhesive in a predetermined pattern on the upper 42, and then following the steps outlined above of applying the flock material to the adhesive, curing the adhesive, and then removing excess flock material from portions not coated with adhesive.

Figure 4:
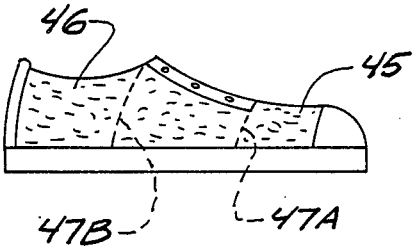
FIG. 4 is a side elevational view of a shoe having the entire side panels of the shoe flocked in accordance with the present invention.

FIG. 4 shows an athletic shoe 45 that has been flocked over its entire upper 46, using the process of the present invention. The entire upper of the shoe is flocked, and has the desired flocked or velvety appearance. The shoe upper can be flocked in sequence to permit one color flock to be applied to the toe and a second color flock applied to the instep area and a third color to the heel as separated by dotted lines 47A and 47B. The colors also can be blended together in the region of the lines 47A and 47B. The adhesive application and flocking is sequential for the different colors.

The adhesive can be colored or pigmented, so that the dye color of the adhesive Will show through the flock, and the flocked fibers themselves of course can be colored in any suitable manner, so that very bright colors, and independent patterns can be obtained on the exterior of the athletic shoes.

As previously mentioned, rayon fibers that are 3 denier and having a length of about 3–4 mm (0.030 inches) is found to provide adequate resistance to scuffing, attractive appearance, and are relatively easy to apply to the adhesive. Nylon flock also can be used.

It should be noted that multicolored patterns can be applied as well, either by sequentially passing a shoe through the flocking process and adding adhesive in the desired pattern before each of the individual flock fiber applications. Alternatively, the pattern variation can be made by applying adhesive, using a mask and applying a first type of flock, and then applying a second type of flock, removing the mark to one or more areas of the adhesive that was previously masked.

Multi color flock can be used, so stripes 41 are one color and stripe 41A is a different color. Both flocked areas can be different from the color of the shoe. Also, the length of flock 41A may be different for a different affect.

The application of adhesives is performed under conditions specified by the manufacturer to insure safe operation.

Although the present invention has been described with reference to preferred embodiments, workers skilled in the art will recognize that changes may be made in form and detail without departing from the spirit and scope of the invention.

What is claimed is:

1. A process for coating a flexible, canvas athletic shoe having an upper and a sole, comprising the steps of:

applying adhesive at desired locations on the upper;

applying flocking material to embed into the adhesive in at least portions of the upper with end portions of the flock material protruding from the adhesive, the application of flocking material being done electrostically in a chamber having a controlled relative humidity, the application including applying between 20 and 100 kilovolts charge between the upper and the atmosphere in the electrostatic chamber, the flocking material comprising fibers ranging in size between 1 and 10 denier, and between 1 and 10 mm in length; and oven drying the canvas athletic shoe after applying the flocking material, and selecting the adhesive coating to be substantially waterproof when dried and such that it remains flexible to permit the upper to flex.

2. The method of claim 1 wherein said flocking material is a rayon material and has a size in the range of approximately 3 denier and having a length of 3 to 4 mm.

3. The method of claim 1 wherein said adhesive is sprayed on to said upper.

4. The method of claim 1 wherein said adhesive is brushed on to said upper.

5. The process of claim 1 wherein the step of applying adhesive at desired locations on the upper comprises applying adhesive in stripes, and providing flocking material having different colors on respective stripes.

* * * * *